US005695013A

United States Patent [19]

Waldron

[11] Patent Number: 5,695,013

[45] Date of Patent: Dec. 9, 1997

[54] DIRT DISTRIBUTION DEVICE

[75] Inventor: Curtis R. Waldron, Okeechobee, Fla.

[73] Assignee: R&R Enterprises of Okezhobee Inc., Okeechobee, Fla.

[21] Appl. No.: 320,528

[22] Filed: Oct. 11, 1994

[51] Int. Cl.[6] ..... A01B 49/02

[52] U.S. Cl. ..... 172/784; 172/67

[58] Field of Search ..... 37/347, 348; 172/393, 172/445.1, 784, 817, 823

[56] References Cited

U.S. PATENT DOCUMENTS

| | | | |
|---|---|---|---|
| 1,767,017 | 6/1930 | Scheckler | 37/347 |
| 3,804,178 | 4/1974 | West | 172/784 |
| 4,023,624 | 5/1977 | Frisbee | 172/823 |
| 4,643,261 | 2/1987 | Long | 172/784 X |

*Primary Examiner*—Terry Lee Melius
*Assistant Examiner*—Robert Pezzuto
*Attorney, Agent, or Firm*—Carroll F. Palmer

[57] ABSTRACT

A dirt distribution device for attachment to the outboard end of an earth moving blade of a grader machine includes a motor driven rotary dirt slinger carried on a platform that is pivotally carried on a support arm that, in turn, pivots on the clamp unit that mounts the device to the blade. The device serves to sling dirt scraped up by the moving blade over areas inaccessible to the blade, e.g., around the base of trees planted in rows adjacent ditches that require periodic reconditioning by scrapping using grader machines. The device basically includes a turnbuckle or equivalent unit to adjust the radial angle of the support arm relative to the blade and a similar unit to adjust the radial angle of the platform relative to the support arm, but may include further adjustment units to add additional tilt modes to the platform.

11 Claims, 4 Drawing Sheets

DIRT DISTRIBUTION DEVICE

BACKGROUND OF THE INVENTION

1. Field of the Invention

This application relates broadly to earth moving equipment. More particularly, it concerns a unique device to assist in distributing dirt over an extended area during earth movement with a grader blade-type earth moving machine.

2. Description of the Prior Art

Numerous motor driven machines comprising a generally horizontal blade exist for moving earth, e.g., dirt, gavel, sand, etc. They are popularly referred to as bulldozers or graders. The present invention concerns an attachment for the grader class of earth moving equipment to expand the utility thereof.

Grader machines are typically used to move a finite mass of earth from one location to another in a repetitive manner. Depending upon the skill of the operator, such equipment may be manipulated to distribute (spread) earth to a limited extent in addition to simply moving an earth mass from place to place. Attachments for such equipment have been devised to expand the distribution area that may be covered in the operation of such machines, e.g., see U.S. Pat. Nos. 3,148,466; 3,543,861 and 3,804,178. In a related way, distribution attachments have been devised for snow ploughs of the blade type, e.g., see U.S. Pat. Nos. 1,466,187 and 2,241,252. The present invention provides an additional type of attachment for grader type machines to assist in distribution of earth during their operation.

OBJECTS

A principal object of the invention is the provision of a device to assist in distributing earth over an extended area during earth movement with grader blade-type earth moving machines.

Further objects include the provision of an attachment for grader that:

1. Are particularly efficient in clearing and reconditioning drainage ditches in orchards, groves and similar plantings of trees.

2. Are capable of slinging dirt emerging at the end of the blade carried thereby onto areas adjacent the line of travel of the grader, e.g, around the base of trees planted in rows alongside ditches that require periodic scraping and regrading.

3. Can pulverize the large clumps of dirt created by action of the grader blade so that the earth contained therein can be thinly spread on the ambient surface.

4. Can function to free water from masses of soil which otherwise would retain it and contribute to lack of proper drainage of the area being work by the grader.

5. Is useful in covering root systems of trees planted in groves and orchards to (a) prevent them from becoming bare which subjects the trees to disease and (b) return nutrients around the tree mots to promote growth.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of unique dirt distribution devices for attachment to the earth moving blade of a grader machines that basically comprise (a) clamp means for attachment of the device to an end of the earth moving blade, (b) an elongated arm, (c) a platform, (d) pivot means for the platform, (e) prop means to brace such pivot means, (f) motor means carried upon the platform, (g) dirt sling means rotatably carried by the motor means, (h) inboard adjustment means to vary the radial position of the arm relative to the clamp means and (i) outboard adjustment means to vary the radial position of the platform relative to the arm.

The elongated arm is defined by a longitudinal axis, an inboard end section and an outboard end section and is pivotally mounted by its inboard end section to the clamp means.

The platform is defined by an inboard end portion, an outboard end portion, a forward longitudinal side and a rearward longitudinal side.

The pivot means comprises a shaft defined by a forward segment and a rearward segment that extends through the outboard end section of the arm. The inboard end portion of the platform is mounted by the shaft carried by the outboard end section of the arm for pivotal movement of the platform about an axis normal to the longitudinal axis of the arm.

The clamp means comprises a U-shaped member defined by a base and a pair of opposed jaws, the base including a plurality of bolts threaded therein for engagement with the blade and a central bore that receives a bolt upon which the arm is pivoted.

The prop means comprises a elongated bar having a first end juxtaposed to the forward section of the shaft and a second end fixed to the inboard end section of the arm.

The motor means advantageously comprises a hydraulic motor including a drive shaft upon which the dirt sling means is carried for rotation in a plane below and parallel to the platform.

The outboard adjustment means includes a pair of opposed first and second clevises, the first clevis being pivoted to a standard fixed to the outboard end portion of the platform and the second clevis is pivoted to a standard fixed to the prop means. The outboard adjustment means typically comprises a turnbuckle or a hydraulic cylinder.

The inboard adjustment means includes a pair of opposed third and fourth clevises, the third clevis being pivoted to a standard fixed to the outboard end section of the arm and the fourth clevis being pivoted to a standard fixed to the clamp means. The inboard adjustment means typically comprises a turnbuckle or a hydraulic cylinder.

In a preferred embodiment, the elongated arm comprises an inboard section and an outboard section mounted to the inboard section by a rotatory joint unit.

In the typical use of a grader machine, as the machine travels along and its blade scrapes a ribbon of dirt from the earth surface, such ribbon typically travels along the blade toward a discharge end and will be deposited closely adjacent the line of travel of the earth moving blade as large clumps of earth. With the new device of the invention attached to such a grader machine, the dirt ribbon as it discharges from the end of the grader blade will be disintegrated into small particles and slung over an extended area considerably removed from the path of the moving machine. By manipulation of the inboard and outboard adjustment means, the area of land and its distance from the machine travel path may be controlled. For example, in the use of a grader machine to clear and recondition drainage ditches existing in fruit tree groves or orchards, the new attachment devices can be effectively used to sling dirt mulch around the base of the trees as the machine travels down the ditches.

BRIEF DESCRIPTION OF THE DRAWINGS

A more complete understanding of the invention can be obtained by reference to the accompanying drawings in which.

DESCRIPTION OF THE PREFERRED EMBODIMENTS

Figure 1:
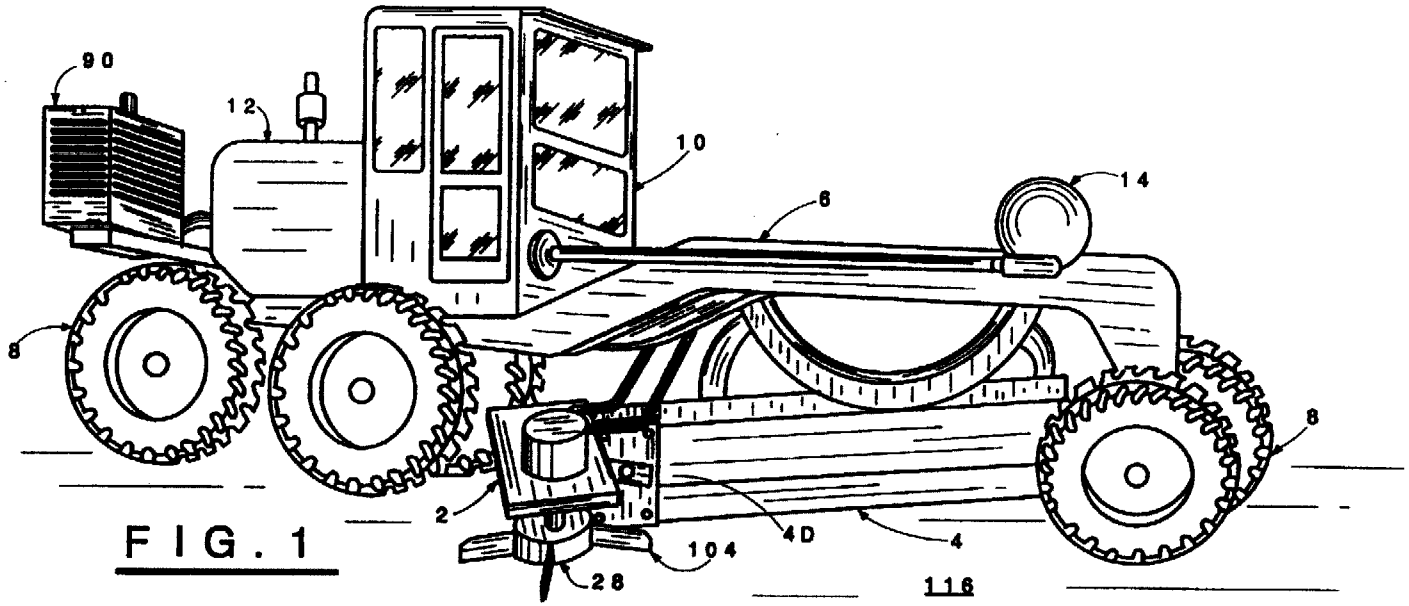
FIG. 1 is an isometric view of a grader machine equipped with a dirt distributing device of the invention.
Figure 2:
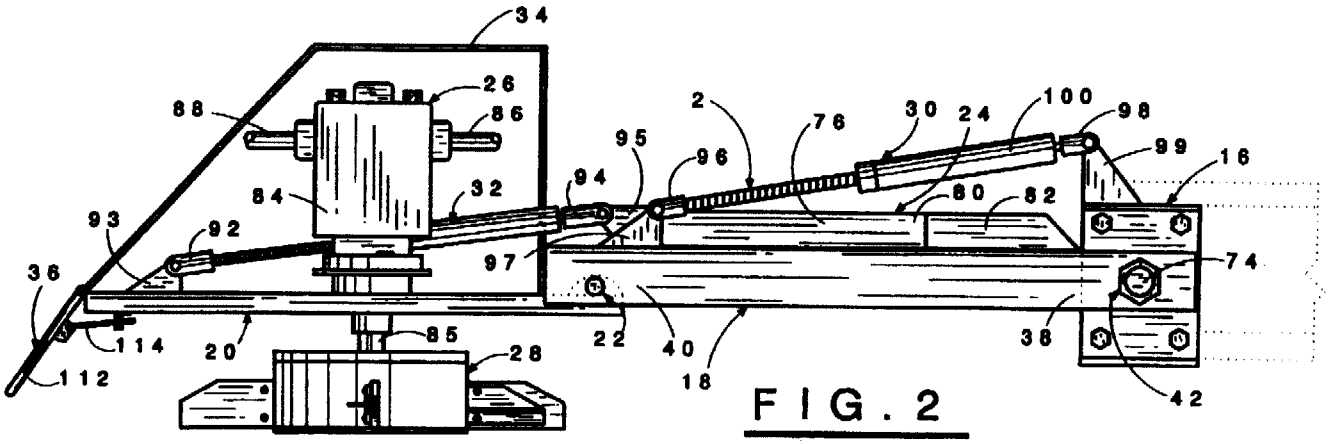
FIG. 2 is a partially sectionalized, lateral view of a first embodiment of a dirt distribution device of the invention.
Figure 3:
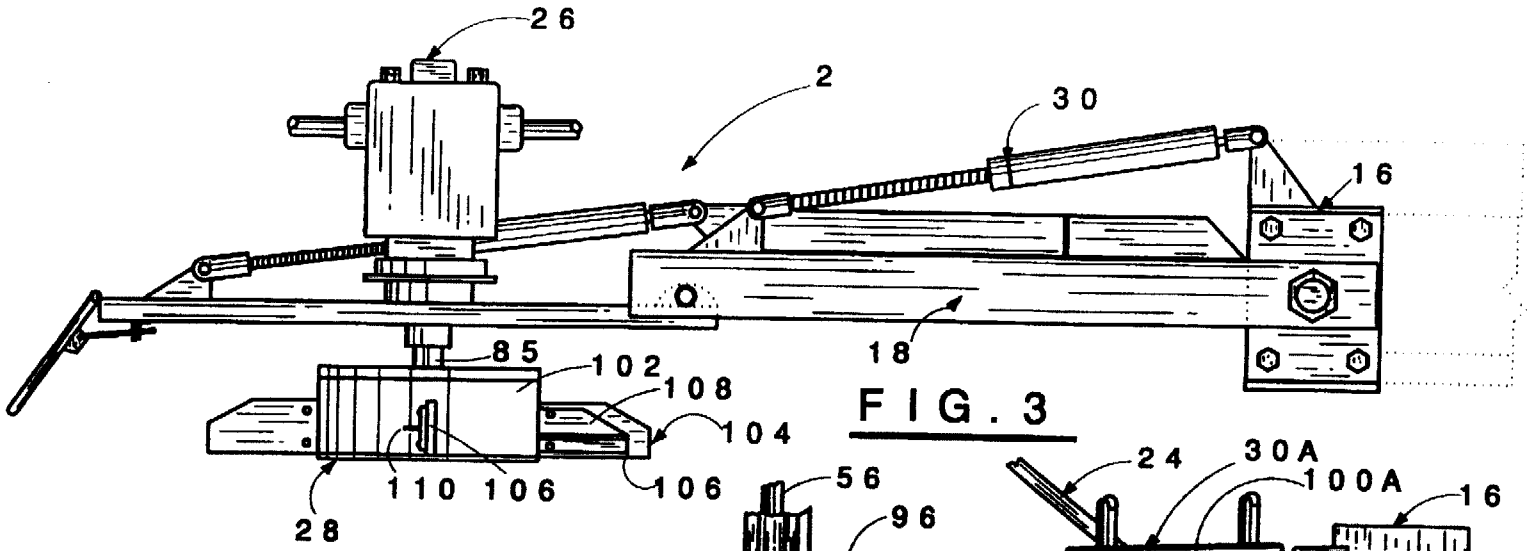
FIG. 3 is a front lateral view similar to FIG. 2 with a cover for the hydraulic motor portion of the device removed.

Referring in detail to the drawings, the dirt distribution device 2 of the invention is designed for attachment to the earth moving blade 4 of a grader machine 6 comprising conventional wheels 8, control cab 10, motor unit 12 and blade adjustments means 14.

The device 2 basically comprises clamp means 16, an elongated arm 18, a quadrilateral platform 20, pivot means 22, prop means 24, motor means 26, dirt sling means 28, inboard adjustment means 30 and outboard adjustment means 32. Optionally, device 2 includes a motor cover 34 and dirt baffle 36.

The arm 18 is elongated along a longitudinal axis and has an inboard end section 38 and an outboard end section 40. It is pivotally mounted by end section 38 to the clamp means 16 by bolt means 42. Typically, arm 18 is formed of 4"×4"×⅜" square metal tubing and is 35.5" in length.

The quadrilateral platform 20 has an inboard end portion 44, an outboard end portion 46, a forward longitudinal side 48 and a rearward longitudinal side 50. Typically, the sides 48 and 50 are formed of 2"×4"×¼" rectangular tubing 29.5" long to which central plate 52 and cross webs 54A, 54B & 54C are welded.

The pivot means 22 comprises a shaft 56 defined by a forward segment 58 and a rearward segment 60 that extends through the outboard end section 40 of the arm 18.

Figure 4:
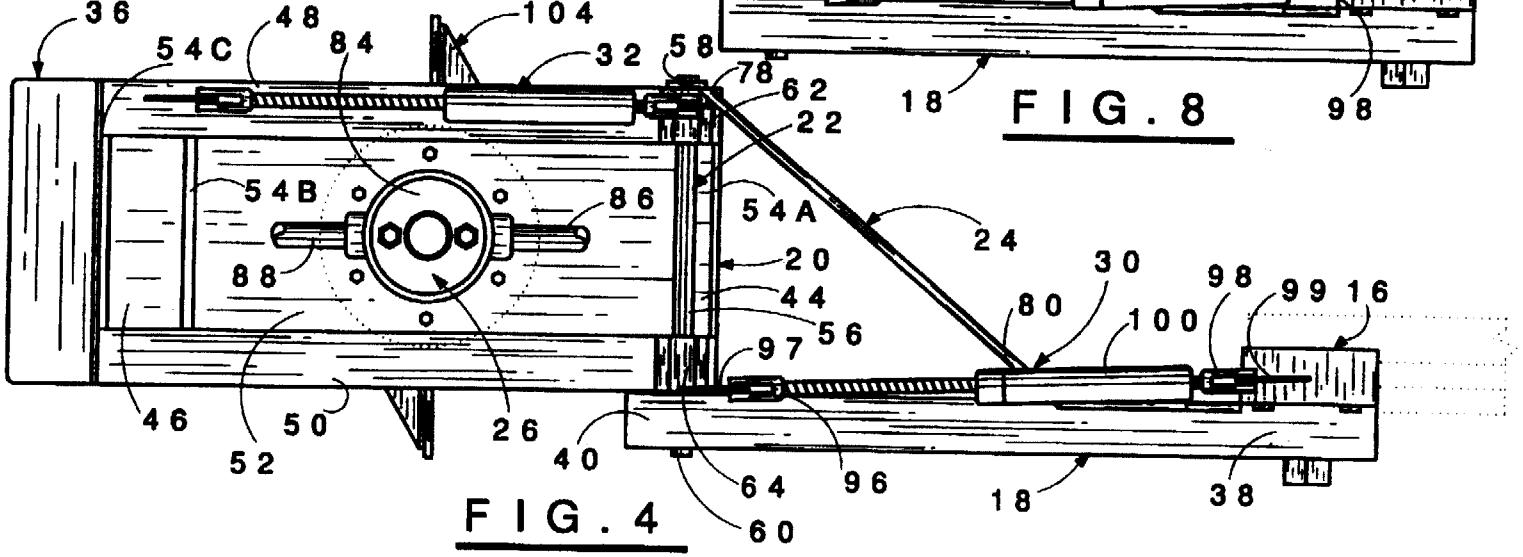
FIG. 4 is a plan view of the device shown in FIG. 3.
Figure 5:
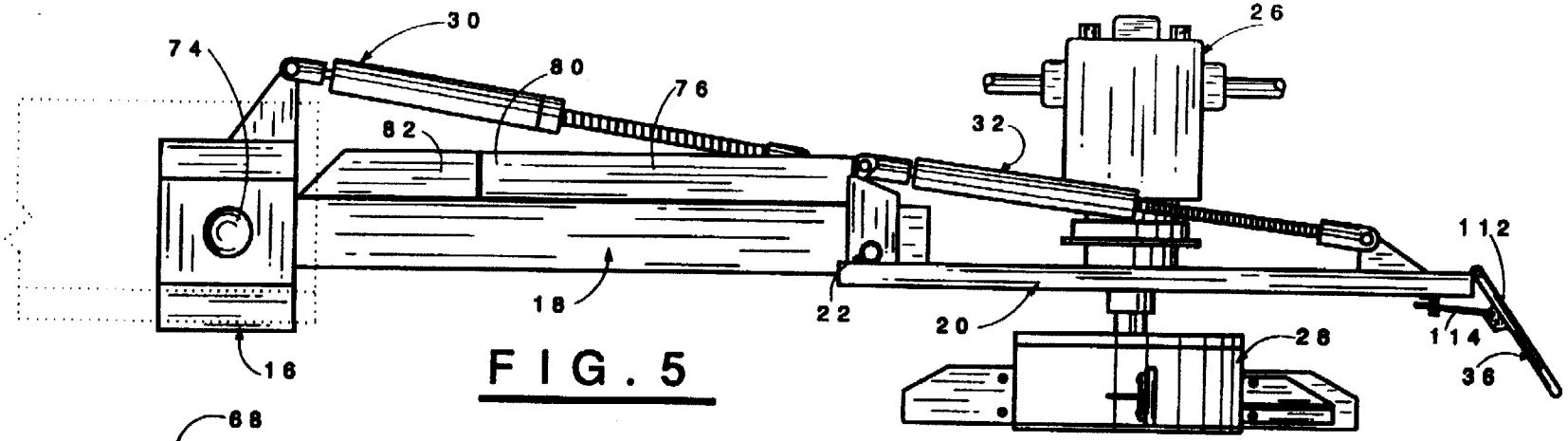
FIG. 5 is a rear lateral view of the first embodiment of the dirt distribution device of the invention.
Figure 6:
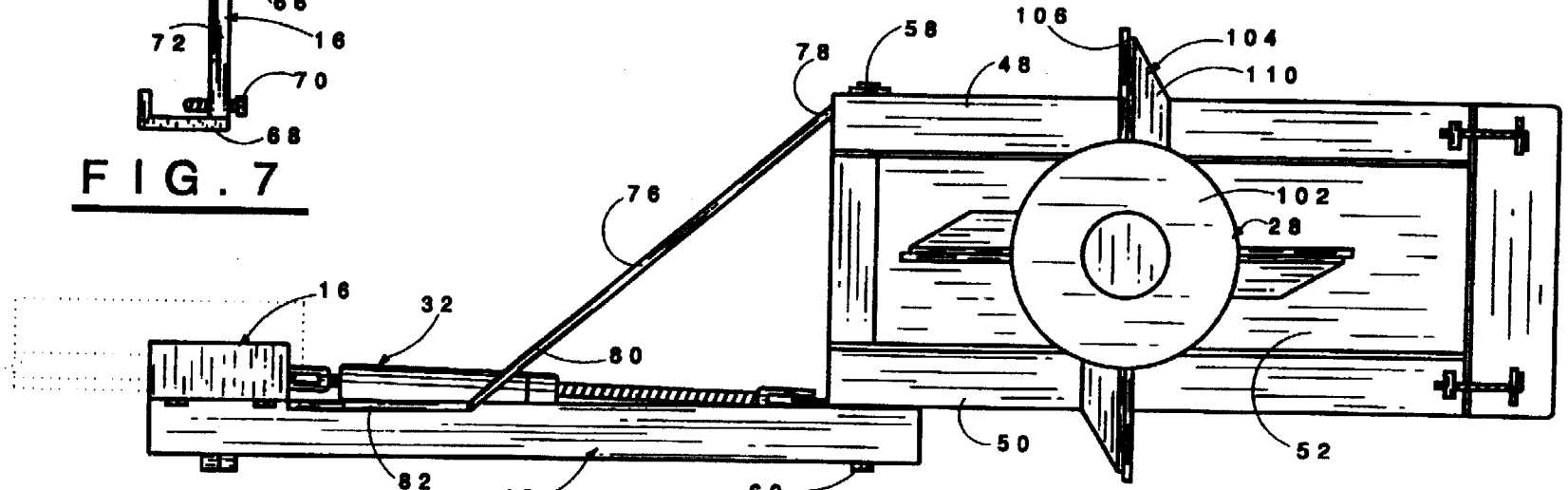
FIG. 6 is a bottom view of the first embodiment of the dirt distribution device of the invention.

As best seen in FIG. 4, the inboard end portion 44 of platform 20 is mounted by journal units 62 & 64 upon shaft 56 for pivotal movement about an axis normal to the longitudinal axis of arm 18.

Figure 7:
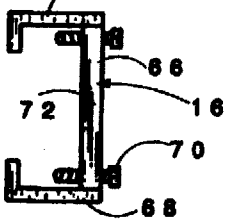
FIG. 7 is a sectional side view of the clamp means for the dirt distribution device.
Figures 9, 10, 11, 12, 13, 14, 15, 16:
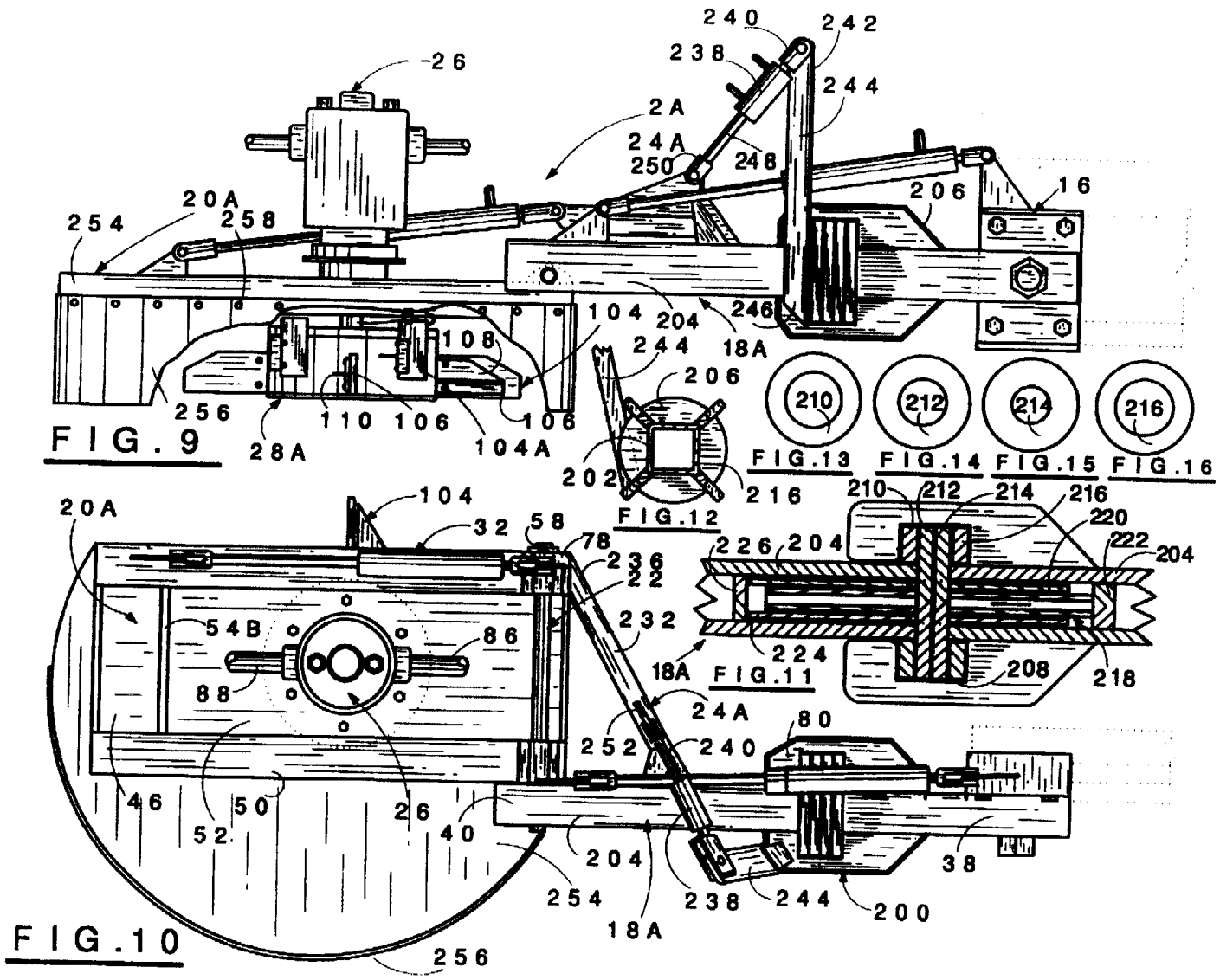
FIG. 9 is a lateral view of a third embodiment of a dirt distribution device of the invention.
FIG. 10 is a plan view of the third embodiment.
FIG. 11 is a fragmentary, sectional view taken on the line XI—XI of FIG. 9.
FIG. 12 is a fragmentary sectional view taken on the line XII—XII of FIG. 10.
FIGS. 13–16 are plan views of discs comprising the axial rotation unit shown in FIGS. 9–11.

As shown in FIG. 7, the clamp means 16 comprises a U-shaped member formed of a quadrilateral base 66 and a pair of opposed jaws 68. Base 66 carries a plurality of bolts 70 threaded therein for engagement with a ledge portion (not detailed) of the earth moving blade 4 and a central bore 72 that receives bolt 74 of means 42 upon which the arm 18 is pivoted.

Prop means 24 comprises a elongated bar 76 having a first end 78 juxtaposed to the forward section 58 of shaft 56 and a second end 80 welded to the arm 18 and a brace bar 82. This prop means 24 serves to stabilize the position of the platform 20 and the position of the shaft 22 normal to the arm 18.

The motor means 26 advantageously comprises a hydraulic motor 84 including a drive shaft 85 upon which the dirt sling means 28 is carried for rotation in a plane below and parallel to the platform 20. Motor means 26 further includes conduits 86 & 88 for supply of pressurized hydraulic fluid to motor 84 from the motorized source 90 mounted on the grader machine 6 to provide torque sufficient to rotate the sling means at typically 1500 RPM.

The outboard adjustment 32 means includes a pair of opposed clevises, the clevis 92 being pivoted to a standard 93 fixed to the outboard end portion 48 of platform 20 and the clevis 94 is pivoted to a standard 95 fixed to the prop means 24. The outboard adjustment means typically comprises a turnbuckle or a hydraulic cylinder.

Figure 8:
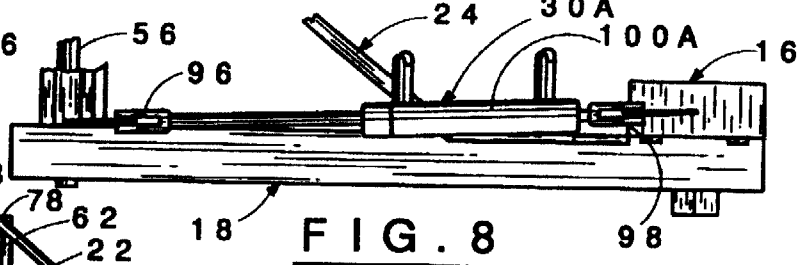
FIG. 8 is a fragmentary, lateral view of a second embodiment of the dirt distribution device of the invention.

The inboard adjustment means 30 includes a pair of opposed clevises, the clevis 96 being pivoted to a standard 97 fixed to the outboard end section 40 of the arm 18 and the clevis 98 being pivoted to a standard 99 fixed to the clamp means 16. The inboard adjustment means 30 comprises a turnbuckle 100 (FIG. 4). An alternative form of adjustment means 30A (FIG. 8) comprises a hydraulic cylinder 100A.

The dirt sling means 28 comprises a drum unit 102 that carries a plurality of paddles 104 formed of a main web 106, a reinforcement web 108 and a transverse, support web 110.

The dirt baffle 36 includes a hinged plate 112 and a positioning screw adjuster unit 114.

In the typical use of the grader machine 6, as it travels along and its blade scrapes a ribbon of dirt (not shown) from the earth surface 116, such ribbon typically travels along the blade 4 toward a discharge end 4D and will be deposited closely adjacent the line of travel of the earth moving blade 4. With the new device of the invention 2 attached to grader machine 6, the dirt ribbon as it discharges from the end 4D of the grader blade 4 will be pulverized into small particles (not shown) and slung over an .extended area considerably removed from the path of the moving machine 6. By manipulation of the inboard outboard adjustment means 30 and outboard adjustment means 32, the area of land and its distance from the machine travel path may be controlled.

The third embodiment of the dirt distribution device 2A shown in FIGS. 9–16 is basically similar to the first embodiment as described above, but comprises a modified arm 18A, a changed platform 20A, different prop means 24A and modified dirt sling means 28A.

A major change in device 2A from device 2 is the provision of the rotation unit 200 in the arm 18A. Thus, arm 18A is formed with an inboard member 202 and an outboard member 204 joined by rotation unit 200.

The unit 200 comprises four braces 206 welded to the four corners of the metal tubing of inboard arm member 202. The braces 206 contain slots 208 that envelope four discs 210, 212, 214 & 216 and form a cage for the discs.

Disc 210 is welded to the braces 206, disc 212 is welded to the inboard end 218 of the outboard arm member 204, disc 214 is welded to the outboard end 220 of the inboard arm member 202 and disc 216 is welded to the braces 206. Accordingly, arm member 204 and disc 212 are free to rotate about the longitudinal axis of the arm 18A relative to the arm member 202 and its attached support disc 214. The two discs 210 & 216 remain fixed with respect to the inboard arm member 202 and serve to stabilize the discs 212 & 214 and the outboard arm member 204.

The rotation unit 200 also comprises brace means 218 that comprises (a) an inner tube 220 fixed to a block 222 that is welded to the inside of arm member 202 and (b) an outer tube 224 fixed to a block 226 that is welded to the inside of arm member 204.

Another major change in device 2A from device 2 is in the prop means 24A. Unlike prop means 24 of device 2, the prop means 24A includes a third adjustment means 228.

The prop means 24A comprises a truncated brace 230 welded to arm member 204 and an elongated brace 232 welded at inboard end 234 to brace 230 and at outboard end 236 to the platform 20A.

Adjustment means 228 comprises a hydraulic piston 238 fixed by a clevis 240 to the upper end 242 of the elongated standard 244 which is welded at its lower end 246 to one of the braces 206 of rotation unit 200.

Adjustment means 228 further comprises a piston rod 248 fastened by clevis 250 to a standard 252 that is welded to the brace 232.

The construction of the adjustment means 228 as described permits the operation of the piston 238 to move the platform 20A and the outboard arm member 204 upon which the platform 20A is fixedly supported about the longitudinal axis of the inboard arm member 202. This gives an additional measure of control to the way in which the sling means 28A distributes earth upon the ambient ground.

The change in dirt sling means 28A for the first embodiment 28 involves the addition of upper staggered paddles 104A in addition to the lower paddles 104. These additional paddles provide increased control on the quality of pulverizing applied to the earth clumps cleaved by the earth mover blade.

The platform 20A of the device 2A is changed from platform 20 of device 2 primarily in the canopy arrangement for the sling means 28A. Thus, the platform 28A includes a cantilevered arcuate projection 254 from which an arcuate apron 256 is suspended by fasteners 258. The apron 256 can be made of a variety of materials, e.g. , flexible, plastic or rubber impregnated fabric, sheet metal, etc.

The operation of device 2A is essentially like that of device 2, but, since the rotation unit 200 adds another axis of tilt to the platform 20A, device 2A enables a higher degree of control of (1) pulverization of earth clumps and (2) range and direction of distribution of the resulting dirt particles.

The embodiments of the invention in which an exclusive property or privilege is claimed are defined as follows:

1. A dirt distribution device for attachment to an earth moving blade of a grader machine which comprises:

clamp means for attachment of said device to an end of said earth moving blade, an elongated arm defined by a longitudinal axis, an inboard end section and an outboard end section, said arm being pivotally mounted by said inboard end section to said clamp means permitting a radial position of said arm relative to said clamp means to be varied, a platform defined by an inboard end portion, an outboard end portion, a forward side and a rearward side, pivot means permitting the radial position of said platform relative to said arm to be varied comprising a shaft defined by a forward segment and a rearward segment mounting said platform by said inboard end portion upon said outboard end section of said arm for pivotal movement of said platform about an axis normal to said longitudinal axis, prop means to brace said pivot means relative to said arm, motor means carried upon said platform, dirt sling means rotatably carried by said motor means, inboard adjustment means to vary said radial position of said arm relative to said clamp means, and outboard adjustment means to vary said radial position of said platform relative to said arm.

2. The dirt distribution device of claim 1 wherein said inboard end section of said arm is mounted to said outboard end section by a rotation unit that permits said outboard end section to rotate relative to said inboard end section along the longitudinal axis of said arm.

3. A dirt distribution device for attachment to the earth moving blade of a grader machine which comprises:

clamp means for attachment of said device to an end of said earth moving blade an elongated arm defined by a longitudinal axis, an inboard end section and an outboard end section, said arm being pivotally mounted by said inboard end section to said clamp means permitting a radial position of said arm relative to said clamp means to be varied, a platform defined by an inboard end portion, an outboard end portion, a forward longitudinal side and a rearward longitudinal side, pivot means permitting the radial position of said platform relative to said arm to be varied comprising a shaft defined by a forward segment and a rearward segment mounting said platform by said inboard end portion upon said outboard end section of said arm for pivotal movement of said platform about an axis normal to said longitudinal axis, prop means to brace said pivot means relative to said arm, motor means carried upon said platform, dirt sling means rotatably carried by said motor means, inboard adjustment means to vary said radial position of said arm relative to said clamp means, and outboard adjustment means to vary said radial position of said platform relative to said arm.

4. The device of claim 3 wherein said clamp means comprises a U-shaped member defined by a quadrilateral base and a pair of opposed jaws, said base including a plurality of bolts threaded therein for engagement with said blade and a central bore that receives a bolt upon which said arm is pivoted.

5. The device of claim 3 wherein said prop means comprises a elongated bar having a first end juxtaposed to said forward section of said shaft and a second end fixed to said inboard end section of said arm.

6. The device of claim 3 wherein motor means comprises a hydraulic motor including a drive shaft upon which said dirt sling means carried for rotation in a plane below and parallel to said platform.

7. The device of claim 3 wherein said outboard adjustment means comprises a turnbuckle.

8. The device of claim 3 wherein said outboard adjustment means comprises a hydraulic cylinder.

9. The device of claim 3 wherein said inboard adjustment means includes a pair of opposed third and fourth clevises, said third clevis being pivoted to a standard fixed to said outboard end section of said arm and said fourth clevis being pivoted to a standard fixed to said clamp means.

10. The device of claim 9 wherein said outboard adjustment means comprises a turnbuckle.

11. The device of claim 9 wherein said outboard adjustment means comprises a hydraulic cylinder.

* * * * *